US005588505A

United States Patent [19]

Heath

[11] Patent Number: 5,588,505

[45] Date of Patent: Dec. 31, 1996

[54] CLEANING ATTACHMENT FOR INTERNAL TUBE MANDREL

[75] Inventor: Phillip T. Heath, Shelbyville, Tenn.

[73] Assignee: Calsonic North America, Inc., Irvine, Calif.

[21] Appl. No.: 489,215

[22] Filed: Jun. 12, 1995

[51] Int. Cl.[6] ..... F16N 1/00

[52] U.S. Cl. ..... 184/18; 184/19; 72/466; 72/150

[58] Field of Search ..... 72/466, 150, 151, 72/152, 153, 154, 370; 184/18, 19, 20; 92/250

[56] References Cited

U.S. PATENT DOCUMENTS

| | | | |
|---|---|---|---|
| 1,253,533 | 1/1918 | Winterhoff | 72/466 |
| 1,526,177 | 2/1925 | Olberding . | |
| 1,552,994 | 9/1925 | Lindeman . | |
| 2,099,723 | 11/1937 | Carver . | |
| 2,779,042 | 1/1957 | Benny . | |
| 2,971,556 | 2/1961 | Armstrong et al. | 72/466 |
| 3,408,850 | 11/1968 | Maier et al. | 72/466 |
| 3,480,982 | 12/1969 | Saunders . | |
| 3,814,525 | 6/1974 | Spencer . | |
| 4,108,279 | 8/1978 | Marcell . | |
| 4,873,778 | 10/1989 | Stipp . | |
| 4,962,607 | 10/1990 | Baldwin . | |
| 5,000,260 | 3/1991 | Fontenot . | |
| 5,407,332 | 4/1995 | Yedinak et al. | 92/250 |

FOREIGN PATENT DOCUMENTS

| | | | |
|---|---|---|---|
| 1165509 | 7/1985 | U.S.S.R. | 72/466 |
| 1731350 | 5/1992 | U.S.S.R. | 72/150 |

*Primary Examiner*—Thomas E. Denion
*Attorney, Agent, or Firm*—Meschkow & Gresham, PLC

[57] ABSTRACT

An internal mandrel assembly is provided that includes a cleaning attachment for cleaning the interior surface of a tube during a bending operation. The internal mandrel assembly includes a mandrel shank, a plurality of mandrel ball assemblies pivotally coupled to the mandrel shank in a linked configuration, a cleaning attachment pivotally coupled to the last mandrel ball assembly, and a locating rod that positions the mandrel shank within the tube. The internal mandrel assembly also cooperates with a lubricant pump and a lubricant collector. The cleaning attachment includes a wiper for cleaning the interior surface of the tube, a linking member, a first support washer, a second support washer, and a retaining shoulder.

21 Claims, 1 Drawing Sheet

PRIOR ART

CLEANING ATTACHMENT FOR INTERNAL TUBE MANDREL

BACKGROUND OF THE INVENTION

1. Field of the Invention

The present invention relates generally to tube bending equipment. More specifically, the present invention relates to mandrels used during tube bending operations. In particular, the present invention is directed to a cleaning attachment for cleaning the interior surface of a tube during a bending operation.

2. The Prior Art

An internal tube mandrel is commonly used to internally support a tube and prevent the tube from collapsing, deforming, crinkling, or binding during a bending operation. Typically, a tube mandrel is inserted into a tube prior to bending, an oil or other suitable lubricant is applied to the interior of the tube, and the tube is advanced over the tube mandrel during the bending operation. Although prior art tube mandrels may adequately prevent tube deformation during the bending process, the lubricant used during the bending process may pose several problems. For example, conventional tube mandrels do not retain the lubricating oil within the tube. As such, when a conventional tube mandrel is used during a tube bending process, the lubricating oil may not be confined to the area where it is needed, i.e., the bending area of the tube. In addition, the oil may also flow past the tube mandrel and out of the tube itself. This loss of oil is wasteful and may cause clean-up problems.

Following a tube bending process that utilizes a conventional tube mandrel, an amount of lubricating oil is inherently left behind within the tube. If the bent tube will be subjected to further manufacturing operations, then the excess oil may be undesirable. For example, if the tube will be subsequently welded or heat treated, then the oil may burn and produce unwanted smoke or fumes. In addition, the remaining oil may flow out of the tube during subsequent handling and create a hazardous and dirty work environment. Thus, the excess oil is usually removed from the tube before further processing.

The removal of the excess oil necessarily requires an additional step that adds to the manufacturing cost and processing time of the finished product. In a typical manufacturing scenario, the excess oil is either washed away or swabbed out of the tube. Following either cleaning process, the excess oil may be lost and nonrecyclable for all practical purposes. In addition, the oil removing process may itself create waste products that must be disposed of or treated.

SUMMARY OF THE INVENTION

Accordingly, it is an advantage of the present invention that an improved internal mandrel assembly having a cleaning attachment is provided.

Another advantage of the present invention is that it provides an internal mandrel assembly that retains the lubricant near the bending area of the tube during the bending process.

A further advantage of the present invention is that a cleaning attachment for an internal mandrel assembly is provided that cleans the interior surface of the tube during the bending process.

A further advantage of the present invention is that a tube bending method is provided that allows the lubricant to be recycled or reused.

Another advantage of the present invention is that it provides a tube bending method that does not require an additional tube cleaning procedure following the bending operation.

The above and other advantages of the present invention are carried out in one form by a cleaning attachment for cleaning the interior surface of a tube during a bending operation that employs an internal mandrel assembly. The cleaning attachment includes a linking member pivotally coupled to the internal mandrel assembly and a wiper attached to the linking member. The wiper is sized to fit within the tube.

BRIEF DESCRIPTION OF THE DRAWINGS

A more complete understanding of the present invention may be derived by referring to the detailed description and claims when considered in connection with the Figures, wherein like reference numbers refer to similar items throughout the Figures, and:

DETAILED DESCRIPTION OF THE PREFERRED EMBODIMENT

Figure 1:
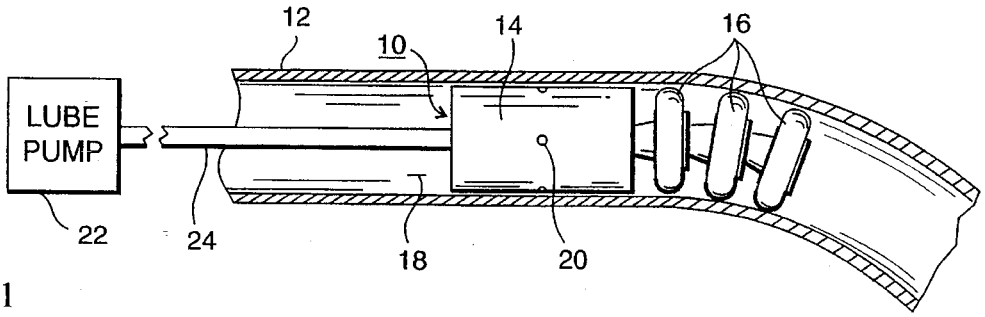
FIG. 1 shows a prior art internal mandrel assembly within a cut-away tube.

FIG. 1 shows an internal mandrel assembly 10 in accordance with the prior art within a tube 12. Mandrel assembly 10 internally supports tube 12 during a bending process to prevent tube 12 from binding, deforming, or crinkling. Mandrel assembly 10 includes a mandrel shank 14 and a plurality of mandrel ball assemblies 16 linked together. Mandrel ball assemblies 16 are pivotally connected to one another such that they provide internal support throughout the bending contour of tube 12. Lubricating oil is applied to the interior surface 18 of tube 12 via a plurality of lubricating holes 20 formed within mandrel shank 14. A lubricant pump 22 feeds the lubricant to lubricating holes 20 through a locating rod 24 that is connected to mandrel shank 14.

Figure 2:
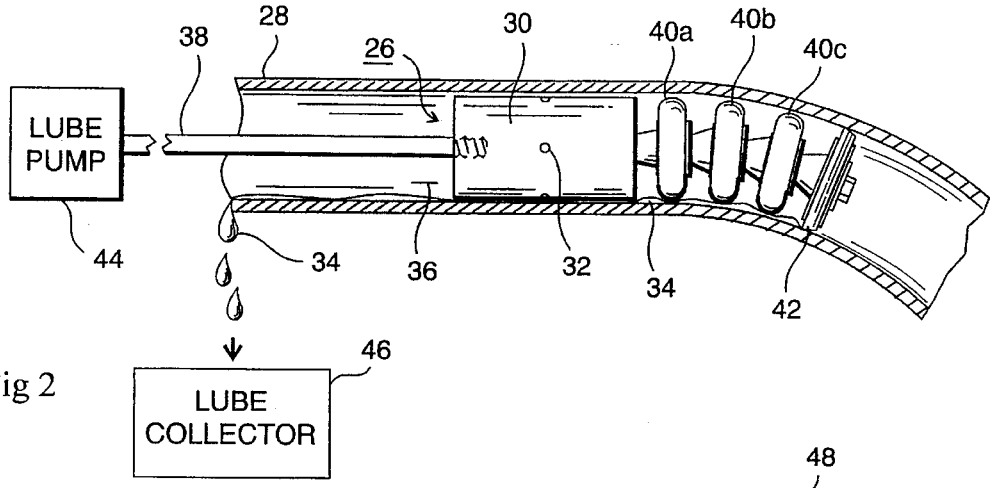
FIG. 2 shows an internal mandrel assembly according to the present invention within a cut-away tube.

With reference to FIG. 2, an internal mandrel assembly 26 according to the preferred embodiment is illustrated within a cut-away tube 28. Generally, mandrel assembly 26 includes a mandrel shank 30, plurality of mandrel ball assemblies 40, a cleaning attachment 42, and a locating rod 38. In addition, mandrel assembly 26 also includes, or cooperates with, a lubricant pump 44 and a lubricant collector 46.

Mandrel shank 30 fits within tube 28 and provides a guide for tube 28 during a bending operation (described below). Mandrel shank 30 preferably includes a plurality of lubricating holes 32 to provide a lubricant 34, such as an oil, to the interior surface 36 of tube 28. The lubricant allows mandrel assembly 26, particularly mandrel ball assemblies 40, to slide within tube 28 during the bending process.

Preferably, mandrel shank 30 connects between locating rod 38 and mandrel ball assembly **40*a*. Mandrel ball assembly 40*a* is pivotally connected to mandrel shank 30, mandrel ball assembly 40***b* is pivotally connected to mandrel ball assembly 40*a*, and mandrel ball assembly 40*c* is pivotally connected to mandrel ball assembly 40*b*. According to one aspect of the preferred embodiment, mandrel ball assemblies 40 are modular assemblies that are interconnected via ball-and-socket joints (see FIG. 4). Those skilled in the art will appreciate that although only three mandrel ball assemblies 40 are depicted in FIG. 2, any number of mandrel ball assemblies 40 may be pivotally coupled together according to individual applications.

Mandrel ball assemblies 40 are sized to provide support to interior surface 36 of tube 28. The pivoting link arrangement of mandrel ball assemblies 40 allows internal mandrel assembly 26 to follow the bending curvature of tube 28 during the bending process. As such, the specific size of each mandrel ball assembly 40 may vary depending upon the size of tube 28. Preferably, mandrel ball assemblies 40 are formed from hard material such as tool steel, or softer material such as ampco bronze.

According to the present invention, cleaning attachment 42 is pivotally coupled to the last mandrel ball assembly in the chain. As depicted in FIG. 2, cleaning attachment 42 is coupled to mandrel ball assembly 40*c*. Preferably, cleaning attachment 42 is connected to mandrel ball assembly 40*c* in the same ball-and-socket manner that mandrel ball assemblies 40 are interconnected (see FIG. 4). Thus, cleaning attachment 42 is also capable of pivoting to follow the bending contour of tube 28. Cleaning attachment 42 is sized to fit snugly within tube 28 such that it contacts the entire inner perimeter of interior surface 36. Cleaning attachment 42 will be described in more detail below in connection with FIGS. 3–4.

As mentioned briefly above, mandrel shank 30 is also attached to locating rod 38. Locating rod 38 positions mandrel shank 30, and the various interconnecting components coupled thereto, within tube 28. Depending upon the specific application, the length of locating rod 38 may vary. As such, according to the preferred embodiment, locating rod 38 is threadably attached to mandrel shank 30. This preferred configuration allows locating rod 38 to be easily changed for different applications. According to the preferred embodiment, locating rod 38 contains a lubricant passage (not shown) formed therein to provide lubricant 34 to mandrel shank 30. As described above, mandrel shank 30 includes a plurality of lubricating holes 32 to provide lubricant 34 to tube 28 during the bending process. Thus, mandrel shank 30 is preferably in fluid communication with the lubricant passage of locating rod 38.

According to the preferred embodiment, lubricant pump 44 is in fluid connection with the lubricant passage of locating rod 38. Lubricant 34 is pumped by lubricant pump 44 through locating rod 38, into mandrel shank 30, through lubricating holes 32, and into tube 28. Lubricant pump 44 may be any conventional pump capable of circulating oils or other lubricating fluids.

Cleaning attachment 42, as the final link in the component chain, cleans interior surface 36 as tube 28 passes over internal mandrel assembly 26. Thus, the excess lubricant 34 is wiped clean and gathered in tube 28 ahead of the newly-formed bend. In addition, cleaning attachment 42 also clears out dirt, residues, and other manufacturing debris from the inside of tube 28. Lubricant 34 is preferably collected in lubricant collector 46 from the end of tube 28 during the bending process. Lubricant collector 46 may be any container, drip pan, or the like, suitably configured for the specific application. If desired, the collected lubricant 34 may be filtered, cleaned, reused, or recycled. With brief reference again to FIG. 1, mandrel assembly 10, according to the prior art, does not include cleaning attachment 42. As such, tube 12 will not be wiped clean of excess oil or debris during a conventional bending process.

In addition to wiping interior surface 36 during the bending operation, cleaning attachment 42 also functions to retain the lubricant in the area proximate to mandrel ball assembles 40. Those skilled in this art will appreciate that the bending area of tube 28 is the area most likely to get overheated during the bending process. In addition, the bending process produces higher frictional forces between mandrel ball assembles 40 and interior surface 36 in the bending area than in other areas of tube 28. Thus, by creating a "seal" near the bending area, cleaning attachment 42 keeps lubricant 34 where it is most needed. With reference again to FIG. 1, the prior art mandrel assembly 10 does not prevent the lubricant from leaking past mandrel ball assemblies 16 and out of tube 12.

Figure 3:
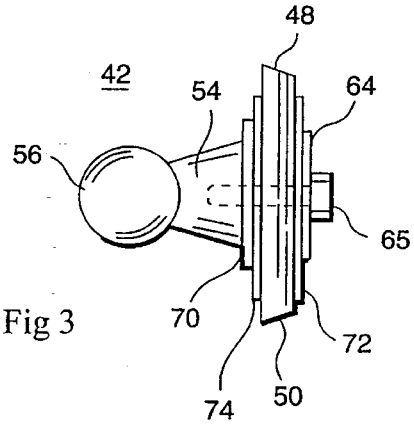
FIG. 3 shows a side view of an assembled cleaning attachment according to the present invention.
Figure 4:
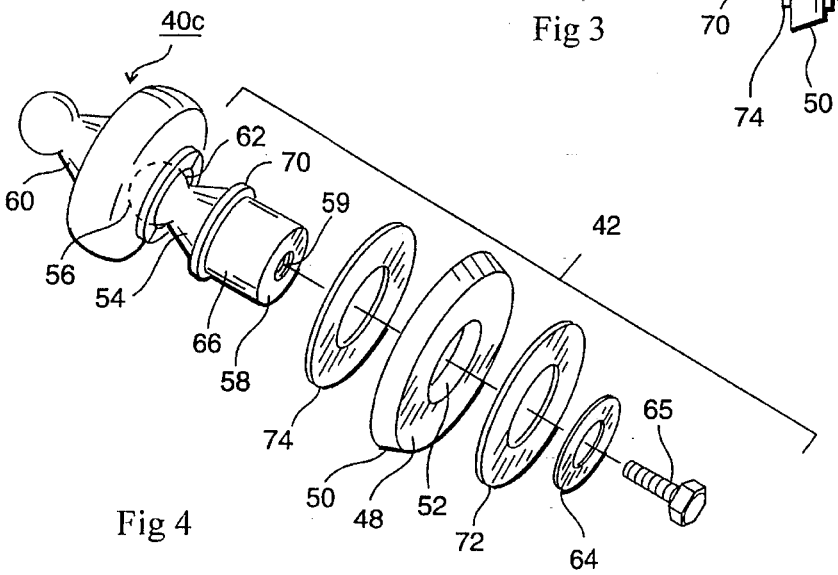
FIG. 4 shows an exploded perspective view of the cleaning attachment.

With reference now to FIGS. 3–4, cleaning attachment 42 is illustrated in detail. Cleaning attachment 42 generally includes a wiper 48, a linking member 54, a retaining shoulder 70, a first support washer 72, and a second support washer 74. As described above, cleaning attachment 42 is configured to clean interior surface 36 of tube 28 during the bending process (see FIG. 2). In addition, cleaning attachment 42 is preferably compatible with existing mandrel ball assemblies such that minimal modifications are required to connect cleaning attachment 42 to an existing internal mandrel assembly.

Wiper 48 is shaped and sized to accommodate the particular tube 28 being bent. Thus, although wiper 48 is shown as a ring-shaped disk, wiper 48 is not limited to any particular configuration. Wiper 48 is preferably formed from an elastomeric material such as rubber, plastic, or vinyl. Due to its intended use, wiper 48 is preferably resistant to oils, cleaning solvents, and the like. Wiper 48 has a perimetrical edge 50 that contacts and cleans interior surface 36 (see FIG. 2) during the bending operation. Preferably, perimetrical edge 50 is in continuous contact with interior surface 36 to ensure proper cleaning and to retain lubricant 34 near the bend area during the bending process. According to one aspect of the preferred embodiment, perimetrical edge 50 is beveled such that wiper 48 has a sharp cleaning edge. In addition, the beveled edge allows easy loading of the tube, and adds a measure of flexibility to wiper 48 during cleaning. Wiper 48 also includes a central mounting hole 52 formed therein, which allows wiper 48 to slidably fit onto linking member 54.

Linking member 54 is the foundation of cleaning attachment 42. Linking member 54 has a connecting end 56 and a free end 58 having a bore 59 formed therein. As described above, cleaning attachment 42 is pivotally coupled to mandrel ball assembly 40*c* of internal mandrel assembly 26. As such, connecting end 56 is preferably ball-shaped to engage with mandrel ball assembly 40*c*. Mandrel ball assembly 40*c* includes a similar linking member 60 that includes a receiving socket 62 configured to receive connecting end 56. A removable retaining shoulder 64 is located at free end 58 of linking member 54. According to the preferred embodiment, retaining shoulder 64 is attachable to free end 58 by a bolt 65. Retaining shoulder 64 retains wiper 48 on linking member 54 when cleaning attachment 42 is assembled.

Linking member 54 also includes a mounting surface 66 formed between connecting end 56 and free end 58. Mounting surface 66 locates wiper 48 on linking member 54 by slidably receiving central mounting hole 52. Thus, according to the preferred embodiment, mounting surface 66 is cylindrical in shape. Retaining shoulder 70, located on linking member 54, prevents the various components from moving forwardly toward connecting end 56.

When cleaning attachment 42 is fully assembled, wiper 48 is sandwiched between first support washer 72 and second support washer 74. Support washer 72 and support washer 74 add structural rigidity to cleaning attachment 42, while preventing wiper 48 from deforming and slipping off of linking member 54 during use. According to the preferred embodiment, linking member 54 is connected to mandrel ball assembly 40*c* prior to the final assembly of cleaning attachment 42. After assembly, bolt 65 is engaged into bore 59 to secure removable retaining shoulder 64 to linking member 54. This preferred configuration allows wiper 48 to be easily replaced without having to disassemble mandrel ball assemblies 40*a–c*.

Internal mandrel assembly 26 may be utilized during a bending operation to clean interior surface 36 of tube 28 (see FIG. 2). To prepare for the bending process, locating rod 38 is selected from a plurality of locating rods having different lengths. The length of locating rod 38 may be dependent upon the length of tube 28, the desired location of the bend, and other manufacturing variables. As described above, locating rod 38 is threadably attached to mandrel shank 30, and the lubricant passage of locating rod 38 is fluidly connected to lubricant pump 44. After locating rod 38 is selected and attached to mandrel shank 30, mandrel assembly 26 is inserted into tube 28.

During the bending process, lubricant pump 44 applies lubricant 34 to interior surface 36 via the lubricant passage in locating rod 38 and lubricating holes 32 in mandrel shank 30. While the bending operation is being performed, interior surface 36 is supported by internal mandrel assembly 26. In particular, the bending area of tube 28 is internally supported by mandrel ball assemblies 40. Tube 28 is bent using conventional tube bending techniques known in the art. According to the preferred embodiment, tube 28 is advanced over internal mandrel assembly 26 during the bending process. As shown in FIG. 2, the bend is formed in tube 28 after tube 28 passes over mandrel shank 30.

While the bending operation is being performed, wiper 48 maintains lubricant 34 in the bend area. The "seal" formed between perimetrical edge 50 and interior surface 36 prevents lubricant 34 from flowing past internal mandrel assembly 26. In addition, wiper 48 cleans interior surface 36 as tube 28 is fed over internal mandrel assembly 26. As the bending operation progresses, the excess lubricant 34 may be collected from tube 28 into lubricant collector 46. Following collection, the excess lubricant 34 may be filtered for further use, disposed of, or recycled. Thus, cleaning attachment 42 removes excess lubricant 34 from interior surface 36 while facilitating the reclamation of lubricant 34 for further treatment.

In summary, the present invention provides an improved internal mandrel assembly having a cleaning attachment pivotally coupled thereto. The cleaning attachment cleans the interior surface of the tube and retains lubricant near the bending area of the tube during the bending process. When utilizing an internal mandrel assembly according to the present invention, the lubricant is easily collected for recycling or reuse. In addition, an additional cleaning process need not be performed after performing a tube bending procedure according to the present invention.

The above description is of a preferred embodiment of the present invention, and the invention is not limited to the specific embodiment described and illustrated. In addition, the process tasks described herein need not be performed in the precise order described. Furthermore, many variations and modifications will be evident to those skilled in this art, and such variations and modifications are intended to be included within the spirit and scope of the invention, as expressed in the following claims.

What is claimed is:

1. A cleaning attachment for cleaning the interior surface of a tube during a bending operation that employs an internal mandrel assembly, said cleaning attachment comprising:

a linking member having a free end, a connecting end configured to pivotally couple to said internal mandrel assembly, and a mounting surface originating proximate said free end and terminating between said connecting end and said free end;

a wiper sized to fit within said tube and having a central mounting hole formed therein, said central mounting hole being configured to slidably engage said mounting surface; and means for securing said wiper to said linking member.

2. A cleaning attachment according to claim 1, wherein:

said wiper has a perimetrical edge; and said wiper is sized such that said perimetrical edge is in substantially continuous contact with said interior surface during said bending operation.

3. A cleaning attachment according to claim 2, wherein said perimetrical edge is beveled.

4. A cleaning attachment according to claim 1, wherein:

said connecting end is substantially ball-shaped; and said connecting end is received in a socket formed within said internal mandrel assembly.

5. A cleaning attachment according to claim 1, wherein said means for securing comprises:

a removable first retaining shoulder located at said free end; and a second retaining shoulder integrally formed in said linking member, wherein said wiper is retained upon said mounting surface between said second retaining shoulder and said first retaining shoulder.

6. A cleaning attachment according to claim 5, further comprising a first support washer located between said first retaining shoulder and said wiper, and a second support washer located between said second retaining shoulder and said wiper.

7. A cleaning attachment according to claim 6, wherein said wiper is substantially ring-shaped.

8. An internal mandrel assembly for cleaning and supporting the interior surface of a tube during a bending operation, said internal mandrel assembly comprising:

a mandrel shank;

a first mandrel ball assembly pivotally coupled to said mandrel shank;

a cleaning attachment comprising:

a linking member having a free end, a connecting end pivotally coupled to said first mandrel ball assembly, and a substantially cylindrical mounting surface continuously formed around said linking member, said mounting surface being located between said connecting end and said free end, a wiper sized to fit within said tube and having a central mounting hole formed therein, said central mounting hole being configured to slidably engage said mounting surface, and means for securing said wiper to said linking member; and means for locating said mandrel shank within said tube during said bending operation.

9. An internal mandrel assembly according to claim 8, further comprising at least one additional mandrel ball assembly pivotally coupled between said first mandrel ball assembly and said cleaning attachment.

10. An internal mandrel assembly according to claim 8, wherein said means for locating comprises a locating rod threadably attached to said mandrel shank.

11. An internal mandrel assembly according to claim 10, wherein:

said locating rod has a lubricant passage formed therein to provide a lubricant to said mandrel shank; and said mandrel shank includes a plurality of lubricating holes formed therein, said lubricating holes being in fluid communication with said lubricant passage to provide said lubricant to said interior surface of said tube.

12. An internal mandrel assembly according to claim 11, further comprising a lubricant pump in fluid communication with said lubricant passage to provide said lubricant to said lubricant passage.

13. An internal mandrel assembly according to claim 11, further comprising a lubricant collector configured to collect said lubricant from said interior of said tube during said bending operation.

14. An internal mandrel assembly according to claim 8, wherein said means for securing comprises:

a removable first retaining shoulder located at said free end; and a second retaining shoulder integrally formed in said linking member, wherein said wiper is retained upon said mounting surface between said second retaining shoulder and said first retaining shoulder.

15. An improved internal mandrel assembly of the type having a mandrel shank, a mandrel ball assembly pivotally coupled to said mandrel shank, a socket formed within said mandrel ball assembly, and means for locating said mandrel shank within said tube during a bending operation, wherein the improvement comprises:

a linking member having a free end and a substantially ball-shaped connecting end configured to reside within said socket such that said connecting end pivotally couples to said mandrel ball assembly; and a wiper attached to said free end, said wiper having a central mounting hole configured to slidably engage said linking member.

16. An improved internal mandrel assembly according to claim 15, wherein said linking member has a substantially cylindrical mounting surface formed around said linking member, said mounting surface originating at said free end, terminating between said connecting end and said free end, and being configured to slidably engage said central mounting hole.

17. An improved internal mandrel assembly according to claim 16, wherein said improvement further comprises:

a removable first retaining shoulder located at said free end; and a second retaining shoulder integrally formed in said linking member, wherein said wiper is retained upon said mounting surface between said second retaining shoulder and said first retaining shoulder.

18. A method for cleaning and supporting the interior surface of a tube during a bending operation, said method comprising the steps of:

providing an internal mandrel assembly having a mandrel shank, a mandrel ball assembly pivotally coupled to said mandrel shank, a socket formed within said mandrel ball assembly, a linking member having a free end and a substantially ball-shaped connecting end configured to reside within said socket such that said connecting end pivotally couples to said mandrel ball assembly, a wiper attached to said linking member proximate said free end, said wiper having a central mounting hole configured to slidably engage said linking member, and a locating rod attached to said mandrel shank;

inserting said internal mandrel assembly into said tube;

applying a lubricant to said interior surface of said tube;

performing a bending operation upon said tube while said interior surface is supported by said internal mandrel assembly;

advancing said tube relative to said internal mandrel assembly during said performing step; and cleaning said interior of said tube with said wiper during said advancing step.

19. A method according to claim 18, further comprising the step of collecting said lubricant from said tube, said collecting step occurring during said performing step.

20. A method according to claim 18, wherein:

said locating rod includes a lubricant passage formed therein to provide said lubricant to said mandrel shank;

said mandrel shank includes a plurality of lubricating holes formed therein, said lubricating holes being in fluid communication with said lubricant passage; and said applying step comprises pumping said lubricant through said lubricant passage and said lubricating holes.

21. A method according to claim 18, further comprising the step of selecting said locating rod from a plurality of locating rods having different lengths, said selecting step occurring before said inserting step.

* * * * *